US005083319A

United States Patent [19]

Grilliot et al.

[11] Patent Number: 5,083,319

[45] Date of Patent: Jan. 28, 1992

[54] UNIVERSALLY ADAPTING COMFORT CHINSTRAP FOR A FIREFIGHTER'S COAT

[76] Inventors: William L. Grilliot; Mary I. Grilliot, both of 1986 Home Ave., Dayton, Ohio 45417

[21] Appl. No.: 543,377

[22] Filed: Jun. 26, 1990

[51] Int. Cl.[5] ..... A41D 13/00

[52] U.S. Cl. ..... 2/98; 2/81

[58] Field of Search ..... 2/81, 96, 98, 100, 129, 2/131, 132, 141 R

[56] References Cited

U.S. PATENT DOCUMENTS

| | | | |
|---|---|---|---|
| 808,543 | 12/1905 | Horak | 2/98 |
| 3,231,899 | 2/1966 | Seidel | 2/98 |
| 4,507,806 | 4/1985 | Coombs | 2/81 |
| 4,604,759 | 8/1986 | Bowman | 2/81 |
| 4,748,691 | 6/1988 | Grilliot | 2/81 |
| 4,959,876 | 10/1990 | Kalaam | 2/81 |

*Primary Examiner*—Werner H. Schroeder
*Assistant Examiner*—Diana L. Biefeld
*Attorney, Agent, or Firm*—Jacox & Meckstroth

[57] ABSTRACT

A firefighter's coat having a chinstrap which is universally adapting and which automatically properly fits the chin and neck region of a firefighter who wears the firefighter's coat and which is comfortable to the firefighter. The chinstrap has firefighting protective material in one or more layers of material. Each layer of firefighting protective material is capable of change in configuration to accommodate and fit properly the chin and neck region of the firefighter who wears the firefighter's coat. The material of the chinstrap which engages the chin and neck region of the firefighter is relatively soft and comfortable to the firefighter.

27 Claims, 2 Drawing Sheets

UNIVERSALLY ADAPTING COMFORT CHINSTRAP FOR A FIREFIGHTER'S COAT

BACKGROUND OF THE INVENTION

A firefighter's coat or jacket conventionally includes a chin strap member which protects the neck region of the firefighter from high heat exposure. The chinstrap is conventionally attached to a turned-up collar of the coat or jacket.

Problems exist with regard to the conventional chinstrap. Individual firefighter's have various neck diameters. Chin structure and configuration of firefighters varies significantly. It has been difficult or impossible to provide an adequately protective chinstrap which fits all firefighters comfortably. If a chinstrap is too wide for a firefighter, the chinstrap is uncomfortable. If the chinstrap is too narrow, the chinstrap permits an unprotective gap in the firefighter's chin and neck region. It has been necessary to compromise between a wide chinstrap, for maximum protection, and a narrow chinstrap which may not properly protect the chin and neck region of the firefighters.

Also, a conventional chinstrap is constructed of good firefighting protection material, but the chinstrap is abrasive and uncomfortable rubbing occurs between the firefighter's neck and the chinstrap. If the chinstrap is reduced in dimensions so that it does not rub against 25 the firefighter's neck or chin, the chinstrap may be too small to provide proper protection to the firefighter's neck and chin region.

An object of this invention is to provide a universally adapting chin and neck protective member or chinstrap for a firefighter's coat in which the chin and neck protective member properly covers and protects the neck and chin region of any firefighter who wears the coat, regardless of the shape and size of the firefighter's neck and chin region.

Another object of this invention is to provide such a chin and neck protective member or chinstrap which is comfortable when used by any firefighter who wears the coat, regardless of the shape and size of the firefighter's neck and chin region.

Another object of this invention is to provide such a chinstrap which has good firefighting protective qualities.

Another object of this invention is to provide a chinstrap for a firefighter's coat which chinstrap properly and completely protects the chin and neck region of the firefighter but which does not interfere with the firefighter's mask or facepiece.

Another object of this invention is to provide such a chinstrap which can be easily and readily constructed at relatively low costs.

Other objects and advantages of the firefighter's chinstrap of this invention reside in the construction of parts, the combination thereof, the method of production and the mode of use, as will become more apparent from the following description.

SUMMARY OF THE INVENTION

A chin and neck protective member or chinstrap of this invention is attached or attachable to a firefighter's coat. The chinstrap includes firefighting protective material, such as thermal protective material and moisture protective material. Preferably, the chinstrap comprises an outer shell of flame resistant material. The chinstrap also, preferably, includes moisture barrier material and thermal barrier material which are carried by the outer shell material. The outer shell has two spaced-apart portions. Preferably, the two spaced-apart portions are separated by a recess. The spaced-apart portions are relatively movable. Between the spaced-apart portions and within the recess is a section of stretchable relatively soft thermal protective material. Thus, the stretchable material may be stretched as it engages the chin and neck region of a firefighter who wears the firefighters' coat. Thus, the chinstrap is universally adapting in shape and size to accommodate firefighters who have necks and chins of various sizes and shapes. Furthermore, the chinstrap is comfortable to the firefighter while properly fitting the chin and neck region of the firefighter and providing proper protection to the chin and neck region of the firefighter. The moisture barrier material comprises a section of moisture barrier material which is sufficiently large to permit stretching of the stretchable material.

DETAILED DESCRIPTION OF THE PREFERRED EMBODIMENT

Figure 1:
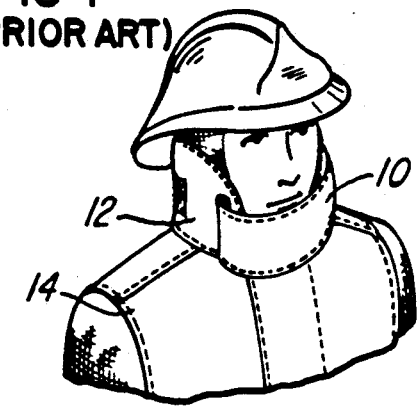
FIG-1 (PRIOR ART)
FIG. 1 is a perspective view showing a portion of a firefighter's coat or jacket and showing a prior art chinstrap as a part of the firefighter's coat.

FIG. 1 shows a prior art chinstrap 10 which is attached to a collar 12 of a firefighter's coat 14. The firefighter's coat 14 and the collar 12 thereof conventionally include an outer shell layer, a thermal barrier layer, and a moisture barrier layer. The outer shell is conventionally of abrasion resistant and flame resistant material. The outer shell has an inner surface which faces the chin and neck region of the firefighter. The outer shell has an outer surface which faces away from the neck and chin region of the firefighter. Within the outer shell and enclosed thereby are one or more layers of thermal protective material and moisture protective material.

The outer shell material is conventionally of the same abrasion resistant and flame resistant material as the outer shell of the coat 14 and the collar 12. Therefore, the surface of the chinstrap 10 which engages the chin and neck region of the firefighter who wears the coat 14 has slight abrasion qualities, and engagement of the chinstrap 10 with the chin and neck of the firefighter is not comfortable to the firefighter. Furthermore, the chinstrap is not designed specifically for the firefighter. Therefore, the neck dimensions and chin structure of the firefighter may be such that the chinstrap 10 does not fit properly upon the neck and chin region of the firefighter. Therefore, a conventional chinstrap, in addition to being uncomfortable to the firefighter may not provide maximum protection to the neck and chin region of the firefighter.

A chinstrap 20 of this invention is shown in FIGS. 2–8 FIG. 2 shows a firefighter's coat 22 which includes a collar 24. The firefighter's coat 22 and collar 24 include firefighting protective materials, such as abrasion resistant material and thermal barrier material and moisture barrier material. These materials may comprise one layer or two layers or three layers or any desired number of layers.

The chinstrap 20 comprises a front panel 30 of abrasion resistant and flame resistant material, which for example, may be a material known as NOMEX, sold by E. I. Dupont & Co., or the front panel 30 may be of any other suitable firefighting protective material. The front panel 30 may be of the same material as that of the outer shell of the coat 22. The front panel 30 is shown as being elongate and provided with a pair of spaced-apart legs **30*a* and 30*b* which form a recess 32 between the legs 30*a* and 30*b*. The recess 32** may be curved, as shown, or of any other suitable shape.

Partially covered by the front panel 30 is an intermediate panel 34. The intermediate panel 34 comprises any suitable moisture barrier layer and may be, for example, a Neoprene material or the like. The intermediate panel 34 is preferably, but not necessarily, a double layer of material. The intermediate panel 34 is provided with a plurality of generally vertical pleats or folds **34*a***.

Behind the intermediate panel 34 is a rear panel 40, which is preferably of the same material as the front panel 30, and, preferably, has substantially the same shape and dimensions as the front panel 30. The rear panel 40 has a pair of spaced-apart legs **40*a* and 40*b* which form a recess 42 in the rear panel 40. The intermediate panel 34 is larger in area than the front panel 30 and the rear panel 40 and extends across the recesses 32 and 42 of the panels 30 and 40**.

Covering the recesses 32 and 42 of the panels 30 and 40, respectively, is a cover section 48, which is preferably, but not necessarily a double layer. The cover section 48 has a front part **48*a* which is attached to the front panel 30. The cover section 48 has a rear part 48*b* which is attached to the rear panel 40**.

The cover section 48 is constructed of thermal barrier fiber material, such as NOMEX or KEVLAR fiber or the like. The fiber is knit and woven so that the cover section can be readily stretched from the condition thereof shown in FIG. 3 to the condition thereof shown in FIG. 4.

The front panel 30 and the intermediate panel 34 and the rear panel 40 and the cover section 48 are all attached together by stitches 47 or the like.

Figure 8:
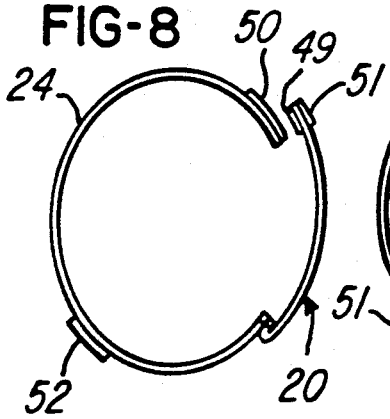
FIG. 8 is a diagrammatic view showing means for selective adjustable attachment of a movable portion of the chinstrap of this invention to the collar of a firefighter's coat for proper fitting of the chinstrap and for proper protection of the chin and neck region of the firefighter.
Figure 9:
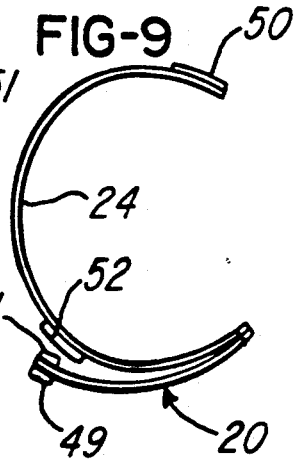
FIG. 9 is a diagrammatic view, similar to FIG. 8, showing the chinstrap out of position for protection of the chin and neck region of the firefighter who wears the coat.
Figure 7:
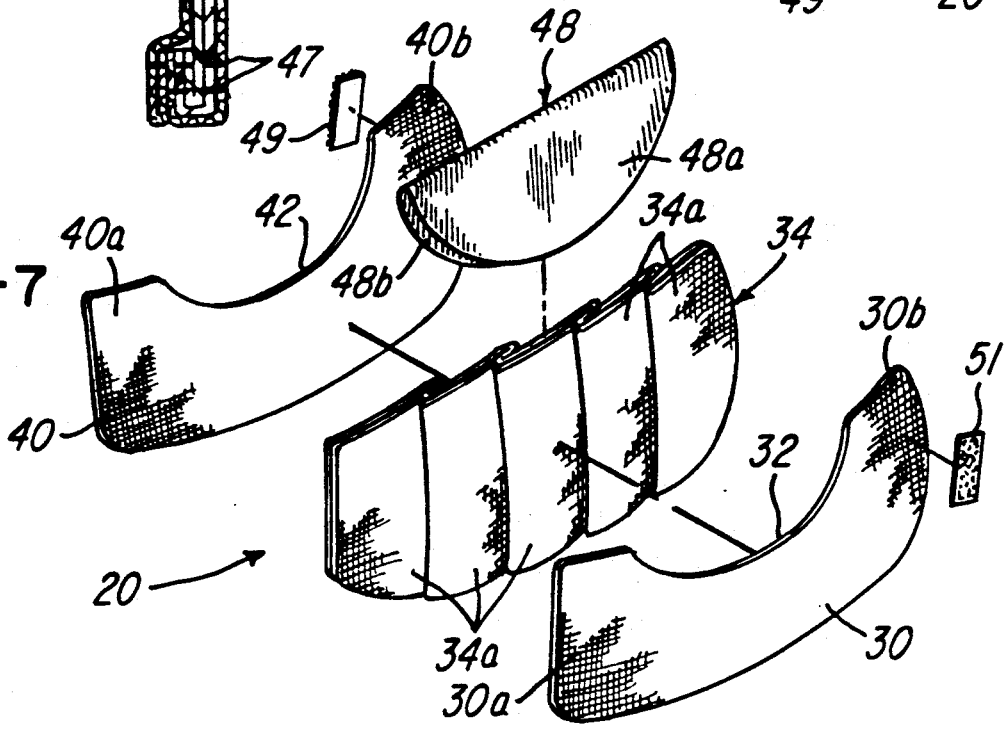
FIG. 7 is an exploded perspective view of a chinstrap of this invention.

As best shown in FIG. 8, on the surface of the leg **40*b* of the rear panel 40 is an attachment member 49, which may be, for example, a hook and pile element. The left side of the collar 24 is provided with complementary hook and pile attachment member 50 to which the attachment member 49 is attachable to maintain the chinstrap 20 in the position illustrated in FIG. 2. On the surface of the leg 30*b* of the front panel 30 is an attachment member 51, which, for example, may be a hook and pile attachment element. As shown in FIG. 9, the attachment member 51 is attachable to a hook and pile element 52 which is carried by the collar 24. Thus, the chinstrap 20 can be attached to the collar 24 as shown in FIG. 2, or the chinstrap 20 can be released from the left side of the collar 24 and attached to the right side of the collar 24 and along the right side of the head of the firefighter and away from the face and chin of the firefighter, as illustrated in FIG. 9**.

Figure 4:
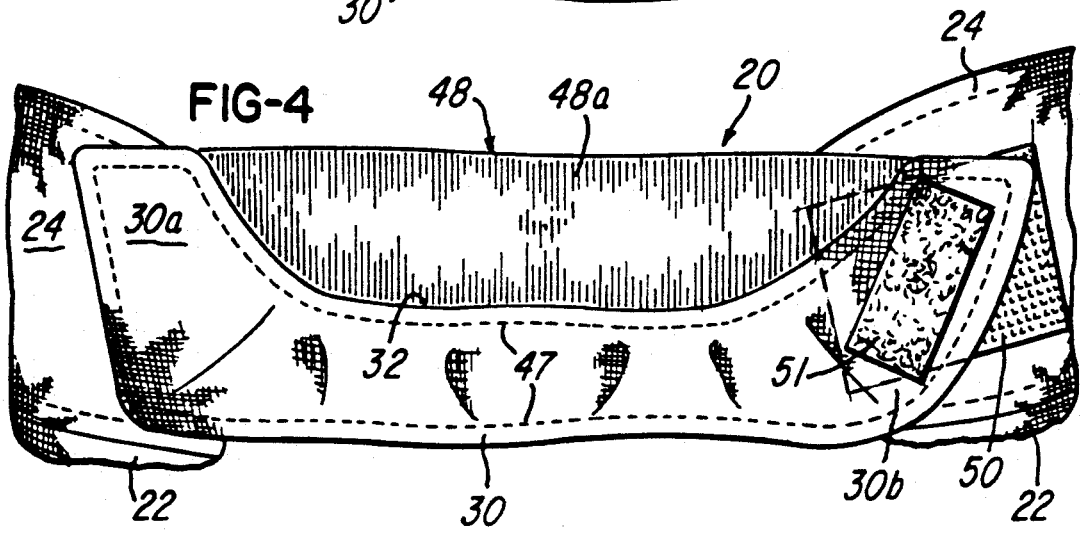
FIG. 4 is a front view, similar to FIG. 3, showing a chinstrap of this invention in an activated condition.
Figure 5:
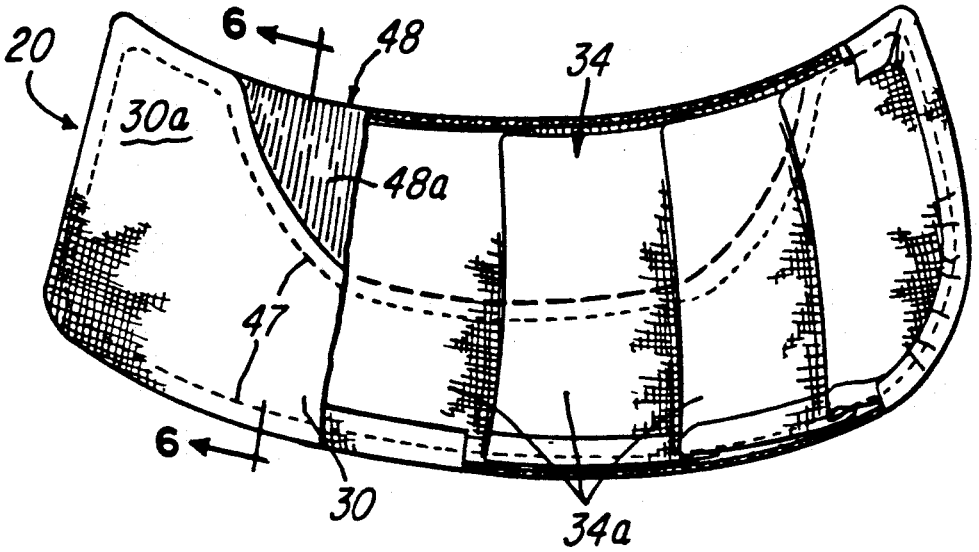
FIG. 5 is a front view with parts broken away and shown in section of a chinstrap of this invention.
Figure 6:
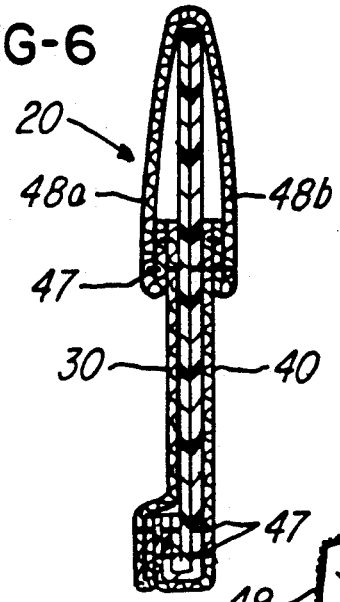
FIG. 6 is an enlarged sectional view, taken substantially on line 6—6 of FIG. 5.

As shown in FIG. 4, the legs **30*b* and 40*b* of the panels 30 and 40, which are attached together, can be moved with respect to the legs 30*a* and 40*a*, which are attached together. Thus, the cover section 48 can be stretched as the legs 30*b* and 40*b* are moved to attach the legs 30*b* and 40*b* to the left portion of the collar 24 and at the left side of the face of the firefighter. The cover section 48 is stretchable, as illustrated in FIG. 4. Therefore, the cover section 48 is stretched and the chinstrap 20 is automatically properly adjusted in length as the chinstrap 20 is brought into engagement with the chin and neck region of the firefighter who wears the coat 22**.

Figure 2:
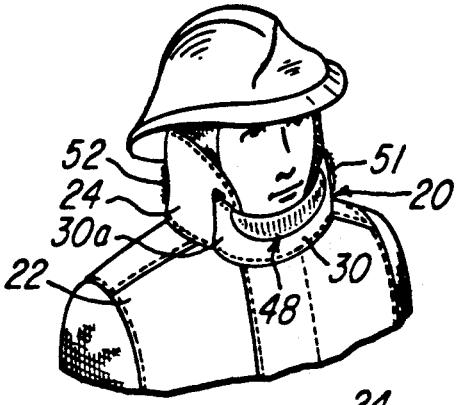
FIG. 2 is a perspective view, similar to FIG. 1, showing a portion of a firefighter's coat or jacket and showing a chin and neck protective member or chinstrap of this invention as a part of the firefighter's coat.
Figure 3:
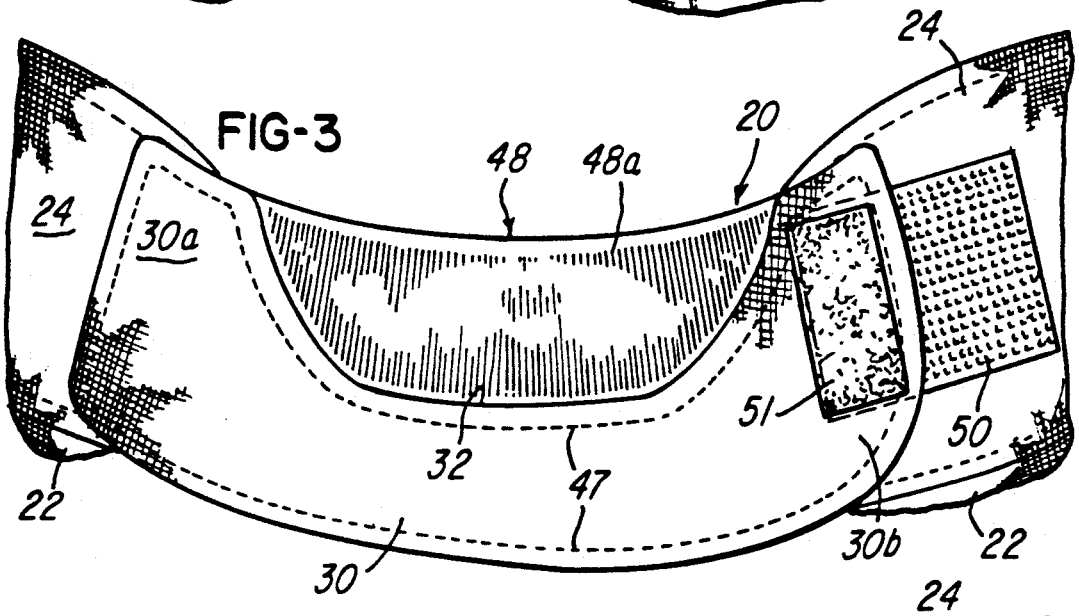
FIG. 3 is a front view, drawn on a much larger scale then FIGS. 1 and 2, showing a chinstrap of this invention in a deactivated condition.

When the chinstrap 20 is positioned as shown in FIG. 2 the attachment element 49 of the leg **40*b* of the rear panel 40 is attached to the attachment member 50 of the collar 24, as illustrated in FIG. 2. The attachment member 50 has a significant area to permit the attachment member 49 to be attached to the attachment member 50 in any one of a plurality of positions upon the attachment member 50. Thus, the attachment member 50 has a sufficient area to permit the leg 40*b* of the rear panel 40 to be attached to the left side of the collar 24 in accordance with the desire of the firefighter who wears the coat 22. Thus, the spacing between the spaced-apart legs 40*a* and 40*b* is adjusted as desired by the firefighter who wears the firefighter's coat. Thus, the chinstrap 20 changes in shape as desired by the firefighter for obtaining a proper protective position of the chinstrap 20 with respect to the chin and neck region of the firefighter. Therefore, the chinstrap 20 is universally adapting and accommodates for any size and shape of a firefighter's neck and chin as the firefighter dons the coat 22 and positions the chinstrap 20. Also, due to the fact that the cover section 48 is of a relatively soft material, the chinstrap 20 feels comfortable to a firefighter as the cover section 48** engages the chin and neck region of the firefighter.

Thus, it is understood that a chinstrap 20 of this invention includes firefighting protective materials, while also providing a properly fitting and comfortable chinstrap.

Although the preferred embodiment of a chinstrap of this invention has been described, it will be understood that within the purview of this invention various changes may be made in the form, details, proportion and arrangement of parts, the combination of parts, and the manner of construction and use, which generally stated consist in a firefighter's chinstrap within the scope of the appended claims.

The invention having thus been described, the following is claimed:

1. A chin and neck protective member for a firefighter's coat of the type provided with a collar which has opposed portions which are on the opposite sides of the head of the firefighter who wears the firefighter's coat, the chin and neck protective member comprising means for attaching the chin and neck protective member to the collar of the firefighter's coat as the chin and neck protective member extends between the opposed portions of the collar of the firefighter's coat and as the chin and neck protective member covers portions of the chin and neck regions of the firefighter, the chin and neck protective member including a main panel of flame resistant material, the main panel having spaced-apart portions which are relatively movable, the spaced-apart portions of the main panel having normal first relative positions, the spaced-apart portions of the main panel having second relative positions in which the spaced-apart portions are farther apart, an intermediate panel of moisture resistant material and a cover panel of thermal barrier material having parts positioned between the spaced-apart portions of the main panel, the intermediate panel and the cover panel having parts which are expandable in area, the spaced-apart portions of the main panel changing from the first relative positions thereof to the second relative positions thereof as the chin and neck protective member is attached to opposed portions of the collar of the firefighter's coat, whereby the chin and neck protective member accommodates for the size and shape of the chin and neck regions of the firefighter who wears the firefighter's coat as the chin and neck protective member extends between the opposed portions of the collar of the firefighter's coat and as the chin and neck protective member is positioned adjacent the chin and neck regions of the firefighter who wears the firefighter's coat, whereby the chin and neck protective member properly covers and protects the chin and neck regions of any firefighter who wears the firefighter's coat.

2. The chin and neck protective member of claim 1 in which at least one of the panels comprises stretchable material which is changeable in configuration as the chin and neck protective member is attached to opposed portions of the collar of the firefighter's coat.

3. The chin and neck protective member of claim 1 in which the thermal barrier material of the cover panel comprises stretchable material which permits the configuration of the chin and neck protective member to be changed as the chin and neck protective member is attached to opposed portions of the collar of the firefighter's coat.

4. The chin and neck protective member of claim 1 in which at least one of the panels comprises a relatively soft stretchable material which is non-abrasive and comfortable to the firefighter as the soft stretchable material engages the chin and neck regions of the firefighter.

5. The chin and neck protective member of claim 1 in which the main panel has a recess between the spaced-apart portions thereof.

6. The chin and neck protective member of claim 1 in which the main panel is generally U-shaped having spaced-apart legs in which the spaced-apart legs comprise the spaced-apart portions of the main panel.

7. A chin and neck protective member for a firefighter's coat which has an upper portion, the chin and neck protective member being adapted to be positioned at the upper portion of the firefighter's coat and adjacent the neck and chin region of a firefighter who wears the firefighter's coat, the chin and neck protective member comprising a first panel, the first panel being constructed of firefighting protective material, the first panel being generally elongate in shape and provided with a pair of spaced-apart sections with a space between the sections, the sections of the first panel being relatively movable, one of the sections of the first panel being attached to a part of the upper portion of the firefighter's coat, means for adjustably attaching the other section of the first panel to another part of the upper portion of the firefighter's coat and adjacent the neck and chin region of the firefighter who wears the firefighter's coat, a second panel, the second panel being positioned within the space between the spaced-apart sections of the first panel and attached to the spaced-apart sections of the first panel, the second panel including firefighting protective material which is stretchable, whereby the chin and neck protective member is capable of properly covering and protecting the neck and chin regions of any firefighter who wears the firefighter's coat as the spaced-apart sections are adjustably attached the upper portion of the firefighter's coat and as the chin and neck protective member properly covers and protects the neck and chin regions of the firefighter.

8. The chin and neck protective member of claim 7 in which the first panel is constructed of flame resistant material, and in which the second panel is constructed of thermal protective material, and in which the chin and neck protective member includes a third panel, the third panel being constructed of moisture barrier material.

9. The chin and neck protective member of claim 7 in which the first panel is constructed of flame resistant material, and in which the second panel is constructed of thermal protective material, and in which the chin and neck protective member includes a third panel, the third panel being constructed of moisture barrier material, the first panel comprising two layers of flame resistant material, the second panel comprising two layers of thermal protective material, the third panel being positioned between the two layers of the first panel and between the two layers of the second panel.

10. The chin and neck protective member of claim 7 in which the first panel is constructed of flame resistant material, and in which the second panel is constructed of thermal protective material.

11. A chin and neck protective member for a firefighter who wears a firefighter's coat, the chin and neck protective member being adapted to be attached to the firefighter's coat adjacent the chin and neck regions of the firefighter who wears the firefighter's coat, the chin and neck protective member comprising firefighting protective material including a layer of thermal barrier material and a layer of moisture barrier material, one of the layers being a first layer and having spaced-apart portions which are relatively movable, another of the layers being a second layer and having spaced-apart portions which are attached to the spaced-apart portions of the first layer, the second layer being expandable in area, whereby the spaced-apart portions of the first layer are relatively movable for adjustable attachment to a firefighter's coat, and whereby the second layer expands in area as the spaced-apart portions of the first layer are moved one from the other, and whereby the chin and neck protector member accommodates for the size and shape of the chin and neck region of any firefighter who wears the firefighter's coat, and whereby the chin and neck protector member properly covers and protects the chin and neck region of any firefighter who wears the firefighter's coat.

12. The chin and neck protective member of claim 11 in which the second layer is thermal barrier material.

13. The chin and neck protective member of claim 11 which includes a layer of flame resistant material having two spaced-apart portions, and a layer of thermal barrier material and a layer of moisture barrier material, the layer of thermal barrier material being expandable material and positioned between the two spaced-apart portions of the layer of flame resistant material.

14. The chin and neck protective member of claim 11 in which the second layer is relatively soft and non-abrasive material and is positioned adjacent the chin and neck region of the firefighter who wears the firefighter's coat, whereby the chinstrap is comfortable to the chin and neck region of the firefighter in addition to being protective of the chin and neck region of the firefighter.

15. A method of providing a chin and neck protective member for a firefighter's coat comprising providing a first layer of firefighting protective material, providing the first layer of firefighting protective material with spaced-apart portions which are relatively movable, providing a second layer of firefighting protective material, providing the second layer of firefighting protective material with spaced-apart portions which are relatively movable, attaching the spaced-apart portions of the first layer of firefighting protective material to the spaced-apart portions of the second layer of firefighting protective material, attaching a layer of stretchable firefighting protective material to spaced-apart portions of the first layer of firefighting protective material and to the spaced-apart portions of the second layer of firefighting protective material, attaching the spaced-apart portions of the first and second layers of firefighting protective material to the firefighter's coat in accordance with the dimensions and shape of the chin and neck regions of the firefighter who wears the firefighter's coat, whereby as the spaced-apart portions of the first and second layers of firefighting protective material are moved one from the other as the spaced-apart portions are attached to the firefighter's coat, and whereby the layer of stretchable firefighting protective material is stretched as necessary for attachment of the chin and neck protective member to the firefighter's coat in a desired position with respect to the chin and neck region of the firefighter who wears the coat.

16. A chin and neck protective member for a firefighter's coat of the type provided with a collar which has opposed portions which are on the opposite sides of the head of the firefighter who wears the firefighter's coat, the chin and neck protective member comprising means for attaching the chin and neck protective member to the collar of the firefighter's coat as the chin and neck protective member extends between the opposed portions of the collar of the firefighter's coat and as the chin and neck protective member covers portions of the chin and neck regions of the firefighter, the chin and neck protective member including a front panel of flame resistant material, an intermediate panel of moisture resistant material and a cover panel of thermal barrier material, the chin and neck protective member having a given normal configuration, the panels including means for changing the configuration of the chin and neck protective member from the normal configuration thereof as the chin and neck protective member is attached to opposed portions of the collar of the firefighter's coat, whereby the chin and neck protective member accommodates for the size and shape of the chin and neck regions of the firefighter who wears the firefighter's coat as the chin and neck protective member extends between the opposed portions of the collar of the firefighter's coat and as the chin and neck protective member is positioned in engagement with the chin and neck regions of the firefighter who wears the firefighter's coat, whereby the chin and neck protective member properly covers and protects the chin and neck regions of any firefighter who wears the firefighter's coat, the moisture resistant material of the intermediate panel being folded, whereby unfolding thereof permits the configuration of the chin and neck protective member to be changed as the chin and neck protective member is attached to opposed portions of the collar of the firefighter's coat.

17. A chinstrap for a firefighter's coat of the type provided with a collar, the chinstrap being attachable to the collar adjacent the chin and neck regions of the firefighter who wears the firefighter's coat, the chinstrap comprising firefighting protective material, the chinstrap having a given normal configuration, said firefighting protective material including means for changing the configuration of the chinstrap from the normal configuration thereof, means for adjustably attaching the chinstrap to the collar of the firefighter's coat in accordance with the chin and neck dimensions and configurations of the firefighter who wears the firefighter's coat, whereby the configuration of the chinstrap is adjusted as desired as the chinstrap is attached to the collar of the firefighter's coat and engages the chin and neck regions of the firefighter to accommodate the chin and neck regions of the firefighter, the chinstrap also including a first panel, the first panel being of firefighting protective material and being generally elongate in shape and having a pair of spaced-apart portions with a space between the spaced-apart portions, a second panel, the second panel being of stretchable firefighting protective material and having a part attached to the spaced-apart portions of the first panel and positioned within the space between the spaced-apart portions of the first panel, whereby the spaced-apart portions of the first panel are movable one with respect to the other, and whereby movement of the spaced-apart portions results in stretching of the stretchable firefighting protective material which is positioned within the space between the spaced-apart portions of the first panel, whereby the configuration of the chinstrap is changed as the spaced-apart portions of the first panel are moved one with respect to the other and as the stretchable firefighting protective material is stretched, and whereby the chinstrap is universally adapting and properly covers and protects the chin and neck regions of any firefighter who wears the firefighter's coat.

18. A chinstrap for a firefighter's coat of the type provided with a collar, the chinstrap being attachable to the collar adjacent the chin and neck regions of the firefighter who wears the firefighter's coat, the chinstrap comprising firefighting protective material, the chinstrap having a given normal configuration, said firefighting protective material including means for changing the configuration of the chinstrap from the normal configuration thereof, means for adjustably attaching the chinstrap to the collar of the firefighter's coat in accordance with the chin and neck dimensions and configurations of the firefighter who wears the firefighter's coat, whereby the configuration of the chinstrap is adjusted as desired as the chinstrap is attached to the collar of the firefighter's coat and engages the chin and neck regions of the firefighter to accommodate the chin and neck regions of the firefighter, the chinstrap also including a first panel, the first panel being of flame resistant material and being generally elongate in shape and having a pair of spaced-apart portions with a space between the spaced-apart portions, a second panel, the second panel being of stretchable thermal barrier material and having a part attached to the spaced-apart portions of the first panel and positioned within the space between the spaced-apart portions of the first panel, whereby the spaced-apart portions of the first panel are movable one with respect to the other, and whereby movement of the spaced-apart portions results in stretching of the stretchable thermal barrier material which is positioned within the space between the spaced-apart portions of the first panel, whereby the configuration of the chinstrap is changed as the spaced-apart portions of the first panel are moved one with respect to the other and as the stretchable thermal barrier material is stretched, and whereby the chinstrap properly covers and protects the chin and neck regions of any firefighter who wears the firefighter's coat.

19. A chinstrap for a firefighter's coat of the type provided with a collar, the chinstrap being attachable to the collar adjacent the chin and neck regions of the firefighter who wears the firefighter's coat, the chinstrap comprising firefighting protective material, the chinstrap having a given normal configuration, said firefighting protective material including means for changing the configuration of the chinstrap from the normal configuration thereof, means for adjustably attaching the chinstrap to the collar of the firefighter's coat in accordance with the chin and neck dimensions and configurations of the firefighter who wears the firefighter's coat, whereby the configuration of the chinstrap is adjusted as desired as the chinstrap is attached to the collar of the firefighter's coat and engages the chin and neck regions of the firefighter to accommodate the chin and neck regions of the firefighter, the chinstrap also including a first panel, the first panel being generally elongate in shape and having a pair of spaced-apart portions with a space between the spaced-apart portions, the spaced-apart portions being relatively movable, attachment means for attachment of spaced-apart portions of the first panel to the collar of the firefighter's coat at adjustably selective spaced-apart positions, a second panel, the second panel including stretchable firefighting protective material, the second panel being attached to the spaced-apart portions of the first panel and positioned within the space between the spaced-apart portions of the first panel, whereby the stretchable firefighting protective material is stretched as the spaced-apart portions of the first panel are moved one with respect to the other and attached to the collar of the firefighter's coat, whereby the configuration of the chinstrap is changed as the spaced-apart portions of the first panel are moved one from the other and as the stretchable firefighting protective material is stretched, whereby the chinstrap properly covers and protects the chin and neck regions of any firefighter who wears the firefighter's coat.

20. A chinstrap for a firefighter's coat of the type provided with a collar, the chinstrap being attachable to the collar adjacent the chin and neck regions of the firefighter who wears the firefighter's coat, the chinstrap comprising firefighting protective material, the chinstrap having a given normal configuration, said firefighting protective material including means for changing the configuration of the chinstrap from the normal configuration thereof, means for adjustably attaching the chinstrap to the collar of the firefighter's coat in accordance with the chin and neck dimensions and configurations of the firefighter who wears the firefighter's coat, whereby the configuration of the chinstrap is adjusted as desired as the chinstrap is attached to the collar of the firefighter's coat and engages the chin and neck regions of the firefighter to accommodate the chin and neck regions of the firefighter, the chinstrap also including a first panel, the first panel being of firefighting protective material and being generally U-shaped with a pair of spaced-apart legs having a space therebetween, the spaced-apart legs being relatively movable, a second panel, the second panel being of firefighting protective material, the second panel being of stretchable material and attached to the spaced-apart legs of the first panel, whereby the stretchable material of the second panel is stretched as the spaced-apart legs of the first panel are moved one from the other, whereby the chinstrap is universally adapting and readily conforms to the shape and configuration of the chin and neck regions of any firefighter who wears the coat.

21. A chinstrap for a firefighter's coat of the type provided with a collar, the chinstrap being attachable to the collar adjacent the chin and neck regions of the firefighter who wears the firefighter's coat, the chinstrap comprising firefighting protective material, the chinstrap having a given normal configuration, said firefighting protective material including means for changing the configuration of the chinstrap from the normal configuration thereof, means for adjustably attaching the chinstrap to the collar of the firefighter's coat in accordance with the chin and neck dimensions and configurations of the firefighter who wears the firefighter's coat, the chinstrap also including a first panel, the first panel being of firefighting protective material and being generally elongate in shape and having a pair of relatively movable spaced-apart portions with a space between the spaced-apart portions, a second panel, the second panel being of expandable firefighting protective material which is expandable in area and having a part attached to the spaced-apart portions of the first panel and positioned within the space between the spaced-apart portions of the first panel, whereby the spaced-apart portions of the first panel are movable one with respect to the other, and whereby relative movement between the spaced-apart portions results in expansion of the area of the expandable firefighting protective material which is positioned within the space between the spaced-apart portions of the first panel, whereby the configuration of the chinstrap is adjusted as desired as the chinstrap is attached to the collar of the firefighter's coat and engages the chin and neck regions of the firefighter to accommodate the chin and neck regions of the firefighter, whereby the chinstrap is universally adapting and properly covers and protects the chin and neck regions of any firefighter who wears the firefighter's coat.

22. A chin and neck protective member for a firefighter who wears a firefighter's coat, the chin and neck protective member being adapted to be attached to the firefighter's coat adjacent the chin and neck regions of the firefighter who wears the firefighter's coat, the chin and neck protective member comprising firefighting protective material including a layer of thermal barrier material and a layer of moisture barrier material, the material of at least one of the layers being a stretchable material, the chin and neck protective member also including a layer of firefighting protective material which is generally U-shaped and having a recess, the layer of stretchable material being attached to the layer which is U-shape and having a portion within the recess, whereby the chin and neck protective member accommodates for the size and shape of the chin and neck region of any firefighter who wears the firefighter's coat, and whereby the chin and neck protective member properly covers and protects the chin and neck region of any firefighter who wears the firefighter's coat.

23. A chin and neck protective member for a firefighter who wears a firefighter's coat, the chin and neck protective member being adapted to be attached to the firefighter's coat adjacent the chin and neck region of the firefighter who wears the firefighter's coat, the chin and neck protective member comprising firefighting protective material including thermal barrier material and moisture barrier material, the chin and neck protective member comprising a U-shaped layer of firefighting protective material which includes a pair of spaced-apart legs having a recess therebetween, the legs of the U-shape layer being relatively movable, a layer of the stretchable material attached to the legs of the U-shape layer and having a portion within the recess, whereby said portion of the layer of stretchable material is stretched as the legs of the U-shaped layer are relatively moved one from the other, whereby the chin and neck protective member accommodates for the size and shape of the chin and neck region of any firefighter who wears the firefighter's coat, and whereby the chin and neck protective member properly covers and protects the chin and neck region of any firefighter who wears the firefighter's coat.

24. A method of providing a chin and neck protective member for a firefighter's coat having an upper portion in which the upper portion of the firefighter's coat is adapted to be positioned adjacent the chin and neck regions of a firefighter who wears the firefighter's coat, comprising providing a layer firefighting protective material, forming a pair of spaced-apart relatively movable portions in the layer of firefighting protective material, attaching one of spaced-apart portions of the layer of firefighting protective material to the firefighter's coat adjacent the upper portion thereof, attaching the other of the spaced-apart portions of the layer of firefighting protective material to a desired position at the upper portion of the firefighter's coat and at a desired position with respect to the first of the spaced-apart portions of the layer of firefighting protective material and in accordance with the size and configuration of the chin and neck regions of the firefighter who wears the firefighter's coat, whereby the layer of firefighting protective material is changeable in configuration as the spaced-apart portions thereof are attached to the firefighter's coat in accordance with the size and configuration of the chin and neck regions of the firefighter who wears the coat, the method including forming a recess between the two spaced-apart portions of the layer of firefighting protective material, positioning a layer of stretchable firefighting protective material between the spaced-apart portions of the layer of firefighting protective material, whereby the chin and neck protective member properly protects the chin and neck regions of any firefighter who wears the firefighter's coat.

25. A method of providing a chin and neck protective member for a firefighter's coat having an upper portion in which the upper portion is adapted to be positioned adjacent the chin and neck regions of a firefighter who wears the firefighter's coat, comprising providing a layer firefighting protective material, forming a pair of spaced-apart relatively movable portions in the layer of protective material, attaching one of spaced-apart portions of the layer of firefighting protective material to the firefighter's coat adjacent the upper portion thereof, attaching the other of the spaced-apart portions to a desired position at the upper portion of the firefighter's coat and at a desired position with respect to the first of the spaced-apart portions and in accordance with the size and configuration of the chin and neck regions of the firefighter who wears the firefighter's coat, whereby the layer of firefighting protective material is changeable in configuration as the spaced-apart portions are attached to the firefighter's coat in accordance with the size and configuration of the chin and neck regions of the firefighter who wears the coat, the method also including forming a recess between the spaced-apart portions of the layer of firefighting protective material, and which includes positioning a layer of stretchable firefighting protective material between the spaced-apart portions of the layer of firefighting protective material, and followed by attaching the layer of stretchable firefighting protective material to the spaced-apart portions of the layer of firefighting protective material, whereby relative movement of the spaced-apart portions one from the other causes stretching of the layer of stretchable material, and whereby the chin and neck protective member properly protects the chin and neck region of any firefighter who wears the firefighter's coat.

26. A method of providing a chin and neck protective member for a firefighter's coat having an upper portion in which the upper portion is adapted to be positioned adjacent the chin and neck regions of a firefighter who wears the firefighter's coat, comprising providing a layer firefighting protective material, forming a pair of spaced-apart relatively movable portions in the layer of protective material, attaching one of spaced-apart portions of the layer of firefighting protective material to the firefighter's coat adjacent the upper portion thereof, attaching the other of the spaced-apart portions to a desired position at the upper portion of the firefighter's coat and at a desired position with respect to the first of the spaced-apart portions and in accordance with the size and configuration of the chin and neck regions of the firefighter who wears the firefighter's coat, the method also including providing a layer of moisture barrier material, forming a plurality of folds in the layer of moisture barrier material, followed by attaching the layer of moisture barrier material to the layer of firefighting protective material, whereby as the spaced-apart portions of the layer of firefighting protective material are relatively moved one from the other the folds in the layer of moisture barrier material permit the chin and neck protective member to change in configuration, whereby the layer of firefighting protective material is changeable in configuration as the spaced-apart portions are attached to the firefighter's coat in accordance with the size and configuration of the chin and neck regions of the firefighter who wears the coat, and whereby the chin and neck protective member properly protects the chin and neck region of any firefighter who wears the firefighter's coat.

27. A method of providing a chin and neck protective member for a firefighter's coat having an upper portion in which the upper portion is adapted to be positioned adjacent the chin and neck regions of a firefighter who wears the firefighter's coat, comprising providing a layer firefighting protective material, forming a pair of spaced-apart relatively movable portions in the layer of protective material, attaching one of spaced-apart portions of the layer of firefighting protective material to the firefighter's coat adjacent the upper portion thereof, attaching the other of the spaced-apart portions to a desired position at the upper portion of the firefighter's coat and at a desired position with respect to the first of the spaced-apart portions and in accordance with the size and configuration of the chin and neck regions of the firefighter who wears the firefighter's coat, whereby the layer of firefighting protective material is changeable in configuration as the spaced-apart portions are attached to the firefighter's coat in accordance with the size and configuration of the chin and neck regions of the firefighter who wears the coat, the method also including forming a recess between the spaced-apart portions of the layer of firefighting protective material, the method also including positioning a layer of expandable firefighting protective material which is expandable in area between the spaced-apart portions of the layer of firefighting protective material, and followed by attaching the layer of expandable firefighting protective material to the spaced-apart portions of the layer of firefighting protective material, whereby relative movement of the spaced-apart portions one from the other causes expansion of the layer of expandable material, and whereby the chin and neck protective member properly protects the chin and neck region of any firefighter who wears the firefighter's coat.

* * * * *